US007621035B2

(12) United States Patent
Yabu

(10) Patent No.: US 7,621,035 B2
(45) Date of Patent: Nov. 24, 2009

(54) GOLF CLUB HEAD

(75) Inventor: Masanori Yabu, Kobe (JP)

(73) Assignee: SRI Sports Limited, Kobe (JP)

( * ) Notice: Subject to any disclaimer, the term of this patent is extended or adjusted under 35 U.S.C. 154(b) by 204 days.

(21) Appl. No.: 11/263,831

(22) Filed: Nov. 2, 2005

(65) Prior Publication Data

US 2006/0058116 A1 Mar. 16, 2006

Related U.S. Application Data

(62) Division of application No. 09/897,141, filed on Jul. 3, 2001, now abandoned.

(30) Foreign Application Priority Data

Jul. 3, 2000 (JP) ..... 2000-201038

(51) Int. Cl.
*B23P 17/00* (2006.01)

(52) U.S. Cl. ..... 29/527.1; 473/350; 473/345

(58) Field of Classification Search ..... 29/527.1; 473/346, 324, 345, 350, 344
See application file for complete search history.

(56) References Cited

U.S. PATENT DOCUMENTS 5,024,437 A 6/1991 Anderson
5,056,705 A 10/1991 Wakita et al.
5,205,560 A * 4/1993 Hoshi et al. ..... 473/345
5,322,206 A 6/1994 Harada et al.
5,346,217 A * 9/1994 Tsuchiya et al. ..... 473/345
5,464,216 A 11/1995 Hoshi et al.
5,851,160 A 12/1998 Rugge et al.
6,162,133 A * 12/2000 Peterson ..... 473/345
6,238,300 B1 * 5/2001 Igarashi ..... 473/324

FOREIGN PATENT DOCUMENTS

JP 3135396 B2 6/1994

* cited by examiner

*Primary Examiner*—David P Bryant
*Assistant Examiner*—Christopher M Koehler
(74) *Attorney, Agent, or Firm*—Birch, Stewart, Kolasch & Birch, LLP

(57) ABSTRACT

A golf club head which comprises a face, a crown, a sole, a sidewall extending from the periphery of the sole towards the crown excluding the face, and a neck to be fixed to a shaft, and the head is formed by welding together a face member for the face, a crown member for the crown and a walled sole member for forming at least the sole and the sidewall, wherein the walled sole member is made by monoblock casting, and the face member and the crown member are each made by plastic deformation processing.

9 Claims, 3 Drawing Sheets

GOLF CLUB HEAD

This application is a Rule 53(b) Divisional of application Ser. No. 09/897,141, filed on Jul. 3, 2001, now abandoned and for which priority is claimed under 35 USC § 120. This application also claims priority of Application No. 2000-201038 filed in Japan on Jul. 3, 2000 under 35 USC § 119; the entire contents of all are hereby incorporated by reference.

BACKGROUND OF THE INVENTION

1. Field of the Invention

The present invention relates to a golf club head having a structure being capable of increasing the degree of freedom of design and the degree of freedom of selecting materials.

2. Description of the Related Art Including Information Disclosed under 37 CFR 1.97-1.99

Conventionally, wood-shaped metallic golf club heads are formed by welding metallic parts together. Such club heads are disclosed in the following prior arts.

In U.S. Pat. No. 5,024,437 (Patent date: 18 Jun. 1991, Filing date: 13 Mar. 1990), a golf club head having a two-piece structure is disclosed, wherein the two pieces are a face plate and a main body. The face plate is fabricated of forged carbon steel, forged stainless steel, forged berylium copper or forged titanium. The main body is formed by investment casting of stainless steel, beryllium copper, titanium, aluminum or the like.

In Japanese patent No. 3135396 (Issue date: 1 Dec. 2000, Laid-open date: 21 Jun. 1994, Filing date: 4 Dec. 1992), a golf club head having a two-piece structure is disclosed. In this case, the head is hollow, and the two pieces are a face plate and a main body. The main body is formed by casting of a titanium alloy. The face plate is fabricated of rolled or forged titanium alloy which is different from the titanium alloy of the main body.

In the laid-open Japanese patent application JP-A-3-51065 (Laid-open date: 5 Mar. 1991, Filing date: 19 Jul. 1989), a golf club head having a two-piece structure is disclosed. In this case, the head is also hollow, and the two pieces are a bottom-opened main body and a sole plate closing the bottom. The main body is formed by casting of titanium or a titanium alloy. The sole plate is fabricated of pressed titanium or a pressed titanium alloy.

In general, castings have a tendency to decrease the strength sharply when the thickness is decreased beyond a certain value due to crystal structure and material imperfection such as air holes. Thus, it is necessary to design the thickness somewhat greater.

In the hollow club heads as in the later two prior arts, therefore, it is difficult to decrease the thickness of the crown for the purpose of lowering the center of gravity, and decrease the thickness of the face for the purpose of improving the restitution coefficient. Further, it is difficult to optimize the position of the center of gravity, weight distribution, moment of inertia and the like of the head. Thus, the freedom of designing the head is considerably limited.

SUMMARY OF THE INVENTION

It is therefore, an object of the present invention to provide a golf club head, in which the degree of design freedom is increased, and the position of the center of gravity, moment of inertia and the like of the club head can be optimized.

According to the present invention, a golf club head comprises a face for hitting a golf ball, a crown, a sole, a sidewall extending from the periphery of the sole towards the crown excluding the face, and a neck to be fixed to a shaft, and the golf club head is formed by welding together a face member for forming the face, a crown member for forming the crown and a walled sole member for forming at least the sole and the sidewall, wherein the walled sole member is made by casting, and the face member and the crown member are each made by plastic deformation processing.

DESCRIPTION OF THE PREFERRED EMBODIMENTS

Figure 1:
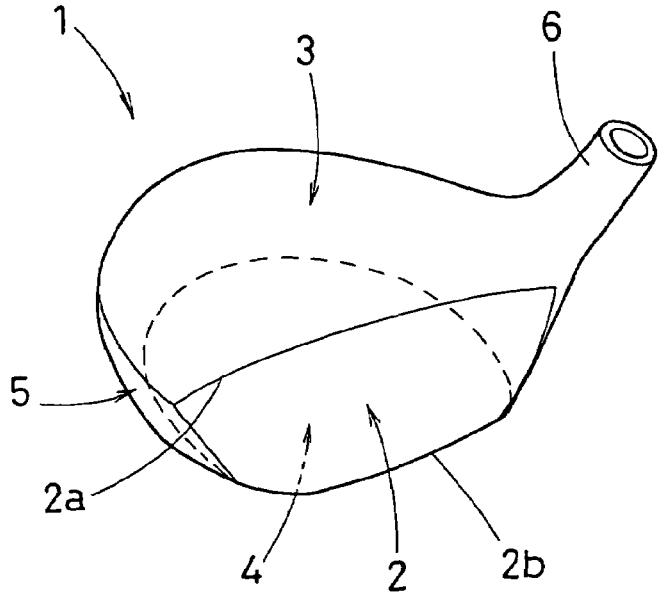
FIG. 1 is a perspective view of a golf club head according to the present invention.

Embodiments of the present invention will now be described in detail in conjunction with the accompanying drawings.

In the drawings, golf club head 1 according to the present invention is a wood-shaped metallic head for a metal wood club.

As shown in FIG. 1, the golf club head 1 is hollow and has a face 2 for hitting a golf ball, a crown 3 defining an upper face of the head intersecting the face 2 along the upper edge 2*a* of the face 2, a sole 4 defining a bottom face of the head intersecting the face 2 along the lower edge 2*b* of the face 2, a sidewall 5 between the crown 3 and sole 4 extending between the toe side edge and heel side edge of the face 2 through the back of the head, and a neck 6 to be fixed to a shaft (not shown).

Figure 3:
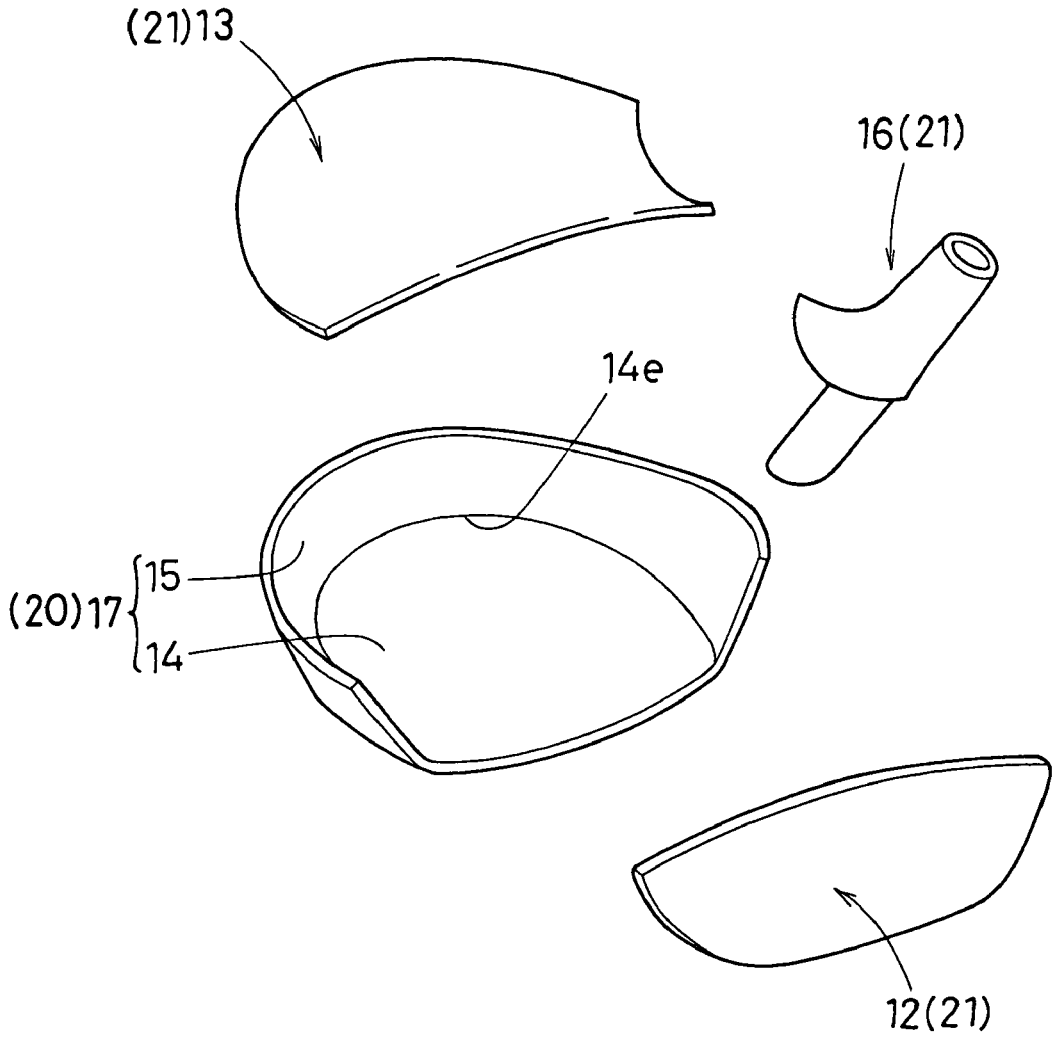
FIG. 3 is an exploded view of the head showing a four-piece structure.

In FIG. 3 showing a first embodiment, the golf club head 1 has a four-piece structure comprising a planar face member 12 for forming the face 2, a slightly curved crown member 13 for forming the crown 3, a neck member 16 for forming the neck 6, and a walled sole member 17 which is composed of a sole part 14 for forming the sole 4 and a sidewall part 15 for forming the sidewall 5, extending upwards from the periphery 14*e* of the sole part 14 excluding the face 2. These members 12, 13, 16 and 17 are welded together.

The walled sole member 17 is made by casting. In other words, the sole part 14 and sidewall part 15 are formed as a monoblock casting 20. Contrary, the face member 12 and crown member 13 are made by plastic deformation processing. In other words, each of the face member 12 and crown member 13 is a plasticity processed piece 21.

Here, the term "plastic deformation processing" means various processing methods being made utilizing plastic deformation to achieve the final shape of the part, inclusive of forging and press forming. The forging includes "cold forging" at room temperature, "warm forging" at an under recrystallization temperature and "hot forging" at an over recrystallization temperature, which may be made using a die, hammer, press or the like. The press forming includes "bending" and "drawing" being made utilizing a press. The processing temperature thereof is not limited here.

As for the casting, on the other hand, it is also possible to employ various methods, but "precision casting" is preferable.

In this example, a "lost-wax precision casting" is employed in making the above-mentioned walled sole member 17 to provide a variable thickness distribution for the sole part 14 and the sidewall part 15 in order to realize an optimum weight distribution.

As for the material of the walled sole member 17, a titanium alloy such as Ti-6Al-4V having a low specific gravity and high strength may be preferably used.

The thickness ratio (t2/t1) between the minimum thickness t1 and maximum thickness t2 of the walled sole member 17 is set in a range of from 1.2 to 3.0, preferably 1.5 to 2.5. For example, the minimum thickness t1 and maximum thickness t2 of the walled sole member 17 are 0.8 mm and 3.5 mm, respectively.

Because the walled sole member 17 which forms the major part of the head is a monoblock casting, it is easy to change the thickness in the sole part 14 and sidewall part 15. Accordingly, a desired weight distribution can be obtained without using a separate weighting member. This increases the degree of freedom of designing the head especially the gravitational center and the moment of inertia.

The face member 12 and crown member 13 in this example are made as follow. A material for each member 12, 13 is punched out in a specific shape (as shown in FIG. 3) from a rolled sheet metal having a substantially uniform thickness. Then, the material is bent by a press.

For example, the thickness of the face member 12 is in a range of from 2.0 to 3.5 mm, preferably 2.0 to 3.0 mm. If the thickness is less than 2.0 mm, the durability and strength thereof are liable to become insufficient. If the thickness is more than 3.5 mm, the restitution coefficient is liable to decrease and the weight distribution is liable to become not good.

The crown member 13 has a substantially constant thickness of from 0.7 to 1.2 mm, preferably 0.7 to 0.9 mm. If the thickness is less than 0.7 mm, the strength becomes insufficient. If the thickness is more than 1.2 mm, the center of gravity of the head becomes high and the golf club is liable to become difficult to handle.

Because the face member 12 and crown member 13 are made by plastic deformation processing, the degree of freedom of selecting the metallic material increases when compared with casting. For example, a titanium alloy Ti-15V-3Al-3Sn-3Cr whose tensile strength is higher than Ti-6Al-4V, can be used although it is not suitable for casting. In this example, such titanium alloy plate is used. Therefore, the thickness of the face member 12 can be decreased to the above-mentioned range without difficulty, thereby improving the restitution coefficient.

The rolled sheet metal has a minute crystalline structure, and its material imperfection such as air holes which are often found in castings is very rare. Accordingly, the rolled sheet metal has a high strength evenly. Therefore, the head can be decreased in the thickness in the face 2 and crown 3, while maintaining a sufficient strength. This also helps to reduce the weight of the head. Further, due to the substantially constant thickness of the face member 12 and crown member 13, accurate positioning of the center of gravity becomes easy in designing the head.

In this embodiment, the above-mentioned neck member 16 is made by forging. But it may be made by pressing, casting, cutting, miling or the like.

Figure 4:
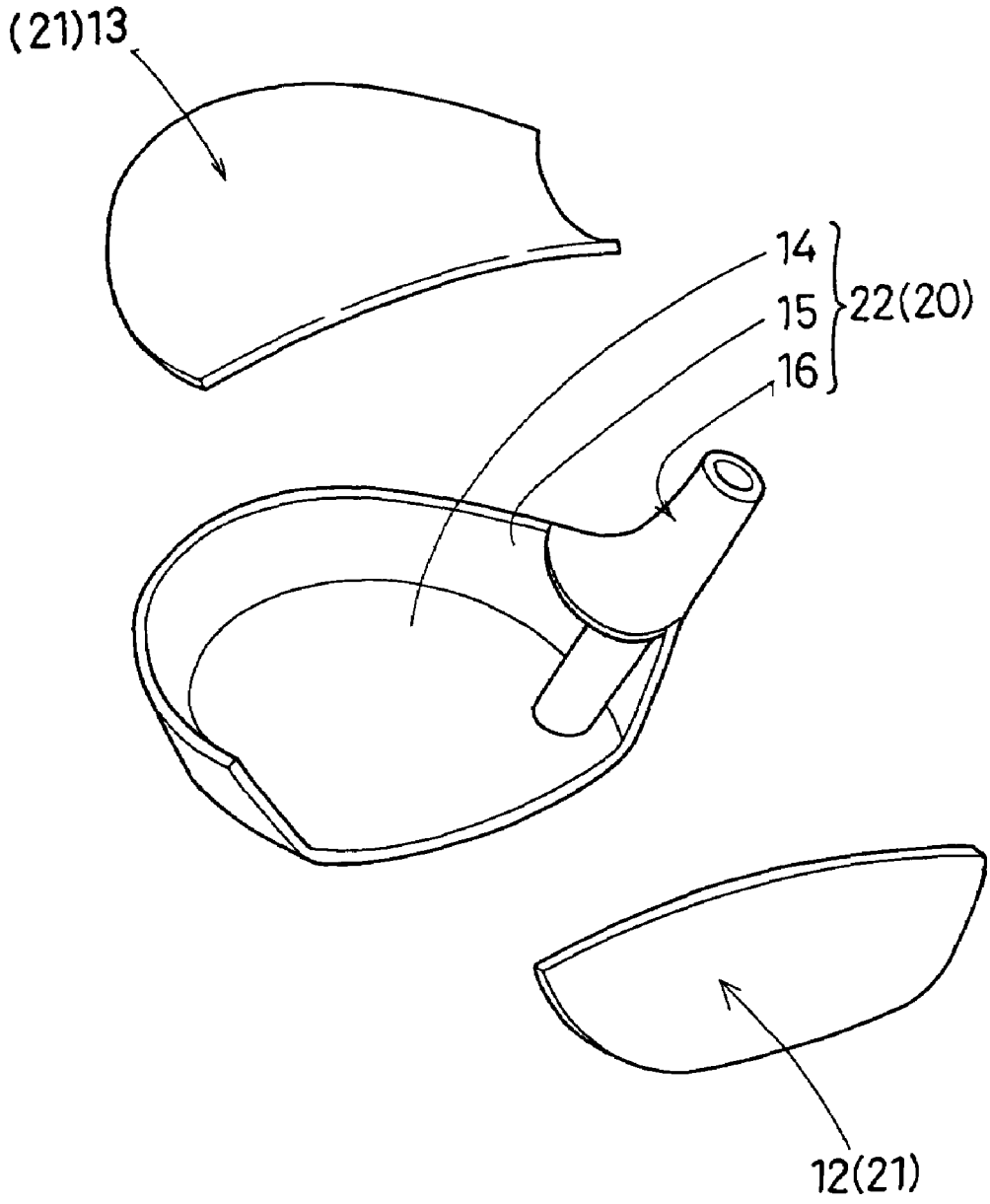
FIG. 4 is an exploded view of the head showing a three-piece structure.

FIG. 4 shows a golf club head 1 according to the present invention which has a three-piece structure.

In this embodiment, the above-mentioned neck member 16 and walled sole member 17 are formed as a monoblock casting (hereinafter the "member 22").

Thus, the member 22 comprises a sole part 14 for forming the sole 4, a sidewall part 15 for forming the sidewall 5, and a neck part 16 forming the neck 6. Accordingly, the golf club head 1 is composed of the member 22, a face member 12 and a crown member 13 which are welded together.

The face member 12 and crown member 13 have been described in the former embodiment. Although the member 22 is made by casting, the face member 12 and crown member 13 are made by plastic deformation processing as explained above. The above description of the walled sole member 17 may be applied to the member 22.

In this embodiment, as the sole part 14, sidewall part 15 and neck part 16 are formed as a monoblock casting, it is easy to improve the accuracy of the neck 6 in respect of its dimension and angle relative to the sole 4 when compared with the separate neck member 16.

In both the embodiments shown in FIG. 3 and FIG. 4, the assembly, namely, the head 1 has the following specifications.

The volume of the head 1 is set in a range of not less than 250 $cm^3$, preferably not less than 280 $cm^3$, more preferably not less than 300 $cm^3$.

The sweet spot height H is set in a range of not more than 28.0 mm.

The depth L of the center of gravity G is set in a range of not less than 36.0 mm.

The lateral moment of inertia of the head is set in a range of not less than 3500 $cm^4$, and the vertical moment of inertia is set in a range of not less than 2000 $cm^4$.

Definition

Sweet spot: The sweet spot SS is defined as a point at which a straight line N drawn normally to the face from the center of gravity G intersects the face.

Standard state: A state that the head is set on a horizontal plane satisfying its lie angle and loft angle.

Sweet spot height H: A vertical height measured from the horizontal plane to the sweet spot SS in the standard state.

Depth L of the center of gravity: The horizontal distance between the center of gravity G and the leading edge E of the head measured in the standard state.

Moment of inertia: The lateral moment of inertia is the moment of inertia around the vertical axis passing through the center of gravity G in the standard state. The vertical moment of inertia is the moment of inertia around a horizontal axis passing through the center of gravity G in the toe-heel direction of the head in the standard state. These moments were measured with "Moment of Inertia Measuring Instrument MODEL NO.005-002, INERTIA DYNAMICS Inc."

As for the metallic material of each of the members 12, 13, 16, 17 and 22, it is preferable that the specific gravity thereof is not more than 5.0. If the specific gravity is more than 5.0, due to weight constraint, it is necessary to decrease the thickness of the material, restricting the rigidity and strength, and requirements for dimensional accuracy will be more strict. For example, titanium alloys, pure titanium, aluminum alloys, magnesium alloys and the like are preferably used. The members 12, 13, 16 and 17 may be of the same material. But, preferably, different materials are used at least between the face member 12 and the other member (17, 22)

Comparison Tests

Wood-shaped golf club heads having the same outward form were made by way of test and tested as follows. The results are shown in Table 1.

Restitution coefficient test: The restitution coefficient e was measured according to the "Procedure for Measuring the Velocity Ratio of a Club Head for Conformance to Rule 4-1e, Appendix II, Revision 2 (Feb. 8, 1999), United States Golf Association." The distance between the face of the club head and the launching device to produce a ball velocity of 160+/−0.5 fps was 55 inches. The radius of the target circle on the face was 5 mm. The golf balls used were "Titleist, PINNACLE GOLD." In Table 1, "A" means the restitution coefficient e is not less than 0.81. "B" means the restitution coefficient e is less than 0.81.

Hook angle deviation test: The hook angle of the face was measured, and the deviation of the measured angle from the design angle was examined. In Table 1, "A" means good. "B" means not good.

TABLE 1

Figure 2:
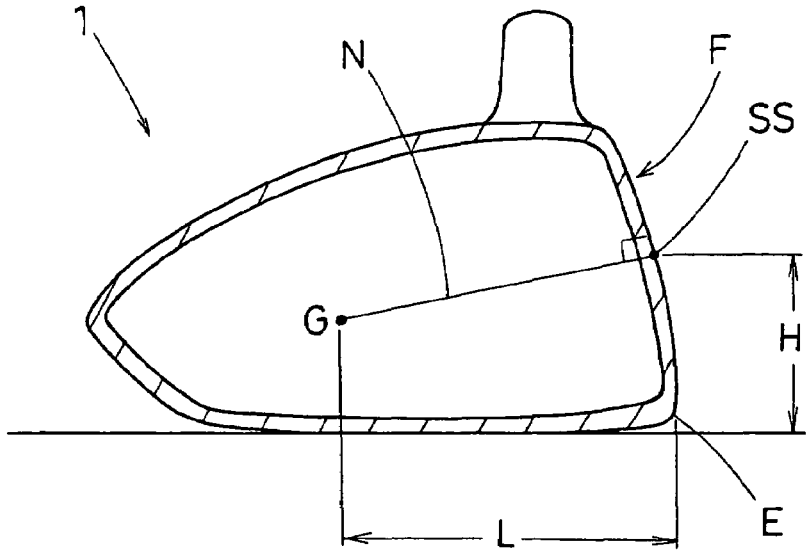
FIG. 2 is a cross sectional view thereof.

| | | Ex. 1 | Ex. 2 | Ref. 1 | Ref. 2 | Ref. 3 |
|---|---|---|---|---|---|---|
| Head volume ($cm^3$) | | | | 320 | | |
| Head weight (g) | | | | 186 | | |
| Making method and Material | Head structure | FIG. 2 | FIG. 3 | FIG. 3 | FIG. 6 | — |
| | Face member | press forming 2.8 mm thick Ti-15V-3Al-3Sn-3Cr | press forming 2.8 mm thick Ti-15V-3Al-3Sn-3Cr | casting 3.0 mm thick Ti-6AL-4V | press forming 2.8 mm thick Ti-15V-3Al-3Sn-3Cr | press forming 2.8 mm thick Ti-15V-3Al-3Sn-3Cr |
| | Crown member | press forming 0.8 mm thick Ti-15V-3Al-3Sn-3Cr | press forming 0.8 mm thick Ti-15V-3Al-3Sn-3Cr | casting 0.9 mm thick Ti-6AL-4V | press forming 0.8 mm thick Ti-15V-3Al-3Sn-3Cr | casting Ti-6AL-4V thickness |
| | Sole part | casting | casting | casting | press forming | crown part 0.9 mm |
| | Wall part | 1.2 to 2.0 mm thick Ti-6AL-4V | 1.2 to 2.0 mm thick Ti-6AL-4V | 1.2 to 2.0 mm thick Ti-6AL-4V | 1.2 mm thick Ti-6AL-4V | sole part 1.2 to 2.0 mm wall part 1.2 to 2.0 mm |
| | Neck part (Outer diameter = 12 mm) | forging Pure Ti | | | press forming Pure Ti | |
| Sweet spot height (mm) | | 28.0 | 27.9 | 28.7 | 29.0 | 28.4 |
| Depth of Center of gravity (mm) | | 37.1 | 36.8 | 35.4 | 34.3 | 35.9 |
| Lateral moment of inertia ($cm^4$) | | 3540 | 3535 | 3512 | 3350 | 3446 |
| Vertical moment of inertia ($cm^4$) | | 2060 | 2055 | 1946 | 1968 | 2035 |
| Restitution coefficient | | A | A | B | A | A |
| Hook angle deviation | | B | A | A | B | A |

In the club heads according to the invention, it was possible to set the sweet spot lower and the center of gravity deeper. It was also possible to set the moment of inertia larger. As the sweet spot height becomes lower, the flying distance may be increased because an excessive backspin is avoided. As the center of gravity G becomes deeper, the sweet area becomes broader, and a loss of the flying distance at the time of miss shot can be minimized. As the moment of inertia becomes larger, the head becomes stable even when missed, and a loss of the flying distance can be decreased.

The invention claimed is:

1. A method of manufacturing a golf club head (a) having a lateral moment of inertia of not less than 3500 g $cm^2$ and a vertical moment of inertia of not less than 2000 g $cm^2$, and (b) comprising (1) a face member for forming a face for hitting a golf ball, (2) a crown member for forming a crown, (3) a walled sole member for forming a sole and a sidewall extending from the periphery of the sole towards the crown excluding the face and (4) a neck member for forming a neck to be fixed to a shaft, the method comprising making the walled sole member and the entirety of the neck member integrally from a first titanium alloy by monoblock casting, so that the walled sole member has a maximum thickness (t2) of at most 3.5 mm and a minimum thickness (t1), and the ratio (t2/t1) of the maximum thickness (t2) to the minimum thickness (t1) is in a range of from 1.5 to 2.5, wherein the monoblock casting is a lost-wax process, making the face member of a different metal material than the walled sole member by plastic deformation processing, wherein the plastic deformation processing is a press forming of a rolled sheet of the metal material, making the crown member having a thickness not more than 1.2 mm and thinner than the face member by press forming of a rolled sheet of a second titanium alloy whose tensile strength is higher than that of the first titanium alloy, and welding the face member, crown member and walled sole member together.

2. The method of manufacturing a golf club head according to claim 1, wherein the volume of the head is not less than 250 $cm^3$.

3. The method of manufacturing a golf club head according to claim 1, wherein the face member, crown member and walled sole member each have a specific gravity of not more than 5.0.

4. The method of manufacturing a golf club head according to claim 1, wherein the volume of the head is not less than 300 $cm^3$.

5. The method of manufacturing a golf club head according to claim 1, wherein the walled sole member is made of Ti-6Al-4V, and the face member and crown member are made of Ti-15V-3Al-3Sn-3Cr.

6. The method of manufacturing a golf club head according to claim 1, wherein the thickness of the face member is not less than 2.0 mm, the sweet spot height is not more than 28.0 mm, and the depth of the center of gravity of the head is not less than 36.0 mm.

7. The method according to claim 1, wherein the thickness of the crown member is in a range of from 0.7 to 1.2 mm, and the thickness of the face member is in a range of from 2.0 to 3.5 mm.

8. A method of manufacturing a golf club head having a lateral moment of inertia of not less than 3500 g $cm^2$ and a vertical moment of inertia of not less than 2000 g $cm^2$, and comprising (1) a face member for forming a face for hitting a golf ball, (2) a crown member for forming a crown, (3) a walled sole member for forming a sole and a sidewall extending from the periphery of the sole towards the crown excluding the face and (4) a neck member for forming a neck to be fixed to a shaft, the method comprising making the walled sole member and the entirety of the neck member integrally from a first titanium alloy by monoblock casting, so that the walled sole member has a maximum thickness (t2) of at most 3.5 mm and a minimum thickness (t1), and the ratio (t2/t1) of the maximum thickness (t2) to the minimum thickness (t1) is in a range of from 1.5 to 2.5, wherein the monoblock casting is a lost-wax process, making the face member of a different metal material than the walled sole member by plastic deformation processing, making the crown member having a thickness not more than 1.2 mm and thinner than the face member from a second titanium alloy whose tensile strength is higher than that of the first titanium alloy, and welding the face member, crown member and walled sole member together, wherein the face member is made by forging said different metal material, and the crown member is made by press forming of a rolled sheet of said second titanium alloy.

9. The method according to claim 8, wherein the thickness of the crown member is in a range of from 0.7 to 1.2 mm, and the thickness of the face member is in a range of from 2.0 to 3.5 mm.

* * * * *